US011959634B1

(12) United States Patent
Jimenez

(10) Patent No.: US 11,959,634 B1
(45) Date of Patent: Apr. 16, 2024

(54) OXYHYDROGEN TORCH SYSTEM AND METHOD OF USE

(71) Applicant: Trio Jimenez, Fort Worth, TX (US)

(72) Inventor: Trio Jimenez, Fort Worth, TX (US)

( * ) Notice: Subject to any disclaimer, the term of this patent is extended or adjusted under 35 U.S.C. 154(b) by 425 days.

(21) Appl. No.: 16/950,061

(22) Filed: Nov. 17, 2020

Related U.S. Application Data

(60) Provisional application No. 62/936,847, filed on Nov. 18, 2019.

(51) Int. Cl.

| | |
|---|---|
| ***F23D 14/42*** | (2006.01) |
| ***F23D 14/40*** | (2006.01) |
| ***F23D 14/46*** | (2006.01) |
| *F23D 14/38* | (2006.01) |
| *F23D 14/52* | (2006.01) |
| *F23D 14/84* | (2006.01) |

(52) U.S. Cl.
CPC ..... *F23D 14/42* (2013.01); *F23D 14/40* (2013.01); *F23D 14/465* (2013.01); *F23D 14/38* (2013.01); *F23D 14/52* (2013.01); *F23D 14/84* (2013.01); *F23D 2207/00* (2013.01); *F23N 2241/11* (2020.01)

(58) Field of Classification Search
CPC ..... F23D 14/42; F23D 14/465; F23D 14/52; F23D 2207/00; F23N 2241/11
USPC ..... 431/127
See application file for complete search history.

(56) References Cited

U.S. PATENT DOCUMENTS

| | | | | |
|---|---|---|---|---|
| 887,467 A * | 5/1908 | Delcampe | F23D 14/42 239/431 |
| 969,875 A * | 9/1910 | Johnson | F23D 14/42 239/419 |
| 1,028,166 A * | 6/1912 | Whitford | F23D 14/38 266/66 |
| 1,055,065 A * | 3/1913 | Miller | F23D 14/42 239/419 |
| 1,258,769 A * | 3/1918 | Harris | F23D 14/42 239/419 |
| 1,328,329 A * | 1/1920 | Johnson | F23D 14/42 239/431 |

(Continued)

FOREIGN PATENT DOCUMENTS

| | | | |
|---|---|---|---|
| CN | 206121981 U * | 4/2017 | |
| EP | 2236927 A1 * | 10/2010 | B23K 7/10 |

(Continued)

*Primary Examiner* — Steven B McAllister
*Assistant Examiner* — Daniel E. Namay
(74) *Attorney, Agent, or Firm* — Richard Eldredge; LEAVITT & ELDREDGE LLC

(57) ABSTRACT

An oxyhydrogen torch system includes a gas storage system having an oxygen gas storage container and a hydrogen gas storage container; a first gas line in communication with the oxygen gas storage container; a second gas line in communication with the hydrogen gas storage container; a nozzle connected to the first gas line and the second gas line via a first valve and a second valve, the first and second valves to control gaseous flow through the nozzle, the nozzle having a handle; a trigger extending from the handle and engaged with the first valve and the second valve, the trigger operates gaseous flow through the nozzle; and an ignition to provide heat to gaseous flow through the nozzle; the nozzle operates a torch created by the hydrogen gas and the oxygen gas.

4 Claims, 4 Drawing Sheets

(56) References Cited

U.S. PATENT DOCUMENTS 1,404,011 A * 1/1922 Coberly ..... F23D 14/38 239/419
1,519,582 A * 12/1924 Harris ..... F23D 14/42 251/239
RE16,307 E * 3/1926 McCutcheon ..... F23D 14/465 239/419
1,784,964 A * 12/1930 Jenkins ..... F23D 14/38 239/394
1,850,379 A * 3/1932 Campbell, Jr. ..... F23D 14/52 239/419
1,860,046 A * 5/1932 McCutcheon ..... F23D 14/465 137/614.19
2,043,982 A * 6/1936 Bruneau ..... F23D 14/465 431/349
2,097,397 A * 10/1937 Heinrich ..... F23D 14/465 137/613
2,275,491 A * 3/1942 Barna ..... F23D 14/44 431/157
RE22,610 E * 3/1945 Barna ..... F23D 14/44 431/157
2,404,590 A * 7/1946 Nantz ..... F23D 14/54 239/291
2,643,622 A * 6/1953 Meincke ..... F23D 14/42 239/419
3,182,334 A * 5/1965 Hammon ..... F23D 14/42 251/126
3,192,987 A * 7/1965 Hammon ..... F23D 14/42 431/207
4,818,220 A * 4/1989 Kobayashi ..... F23D 14/42 431/278
4,832,595 A * 5/1989 Eads ..... F23D 14/38 431/255
2012/0168996 A1* 7/2012 Edenfield ..... F23D 14/42 266/48
2013/0300039 A1* 11/2013 Perisetty ..... B23K 7/00 431/2
2014/0145380 A1* 5/2014 Plut ..... B23K 7/00 266/48
2015/0083233 A1* 3/2015 Smith ..... B23K 37/006 137/87.03
2020/0406384 A1* 12/2020 Zimmerman ..... B23K 7/102

FOREIGN PATENT DOCUMENTS

GB 240728 A * 3/1925 ..... F32D 14/465
JP 62288407 A * 12/1987 ..... F23D 14/42
KR 20130139214 A * 12/2013 ..... B23K 7/00
KR 101589157 B1 * 5/2015 ..... F32D 14/42
WO WO-0230607 A1 * 4/2002 ..... F23D 14/42

* cited by examiner

OXYHYDROGEN TORCH SYSTEM AND METHOD OF USE

BACKGROUND

1. Field of the Invention

The present invention relates generally to torch systems, and more specifically, to an oxyhydrogen torch system that utilizes a nozzle with control features to provide a user with improved control and flexibility in use of the system.

2. Description of Related Art

Torch systems are well known in the art and are effective means to provide a torch function, such as for heating materials, cutting materials, or the like. For example, FIG. 1 depicts a conventional torch system 101 having a nozzle 103 connected to a gas line 105, the gas line 105 in further communication with one or more valves 107, 109 controlling one or more specific gas lines 111, 113. During use, the user will control gas flow via the one or more valves.

One of the problems commonly associated with system 101 is limited user control. For example, the user has limited control over the gas flow to the nozzle, and therefore, the implementation of the torch. This limits the user's ability to use the torch as desired in some circumstances.

Accordingly, although great strides have been made in the area of torch systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
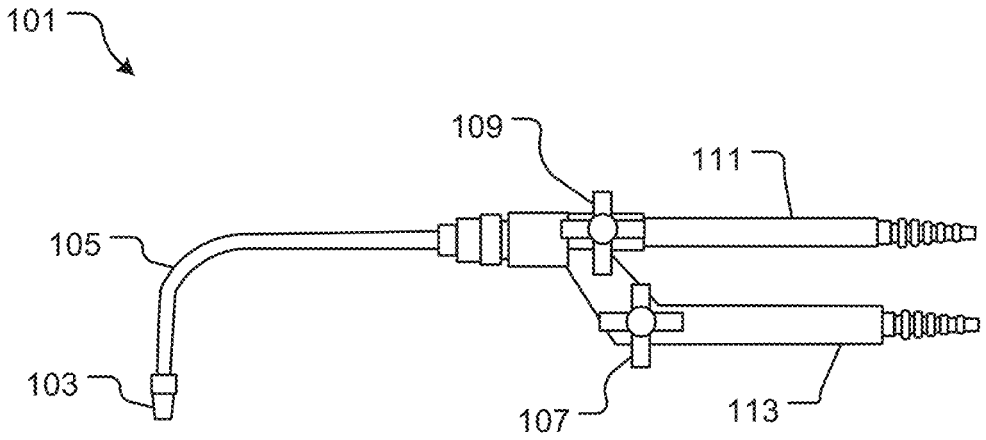
FIG. 1 (Prior Art)
FIG. 1 is a simplified side view of a common torch system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional torch systems. Specifically, the present invention provides for an oxyhydrogen torch system that includes a unique nozzle that allows for improved user control over the operation of the torch functionality. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
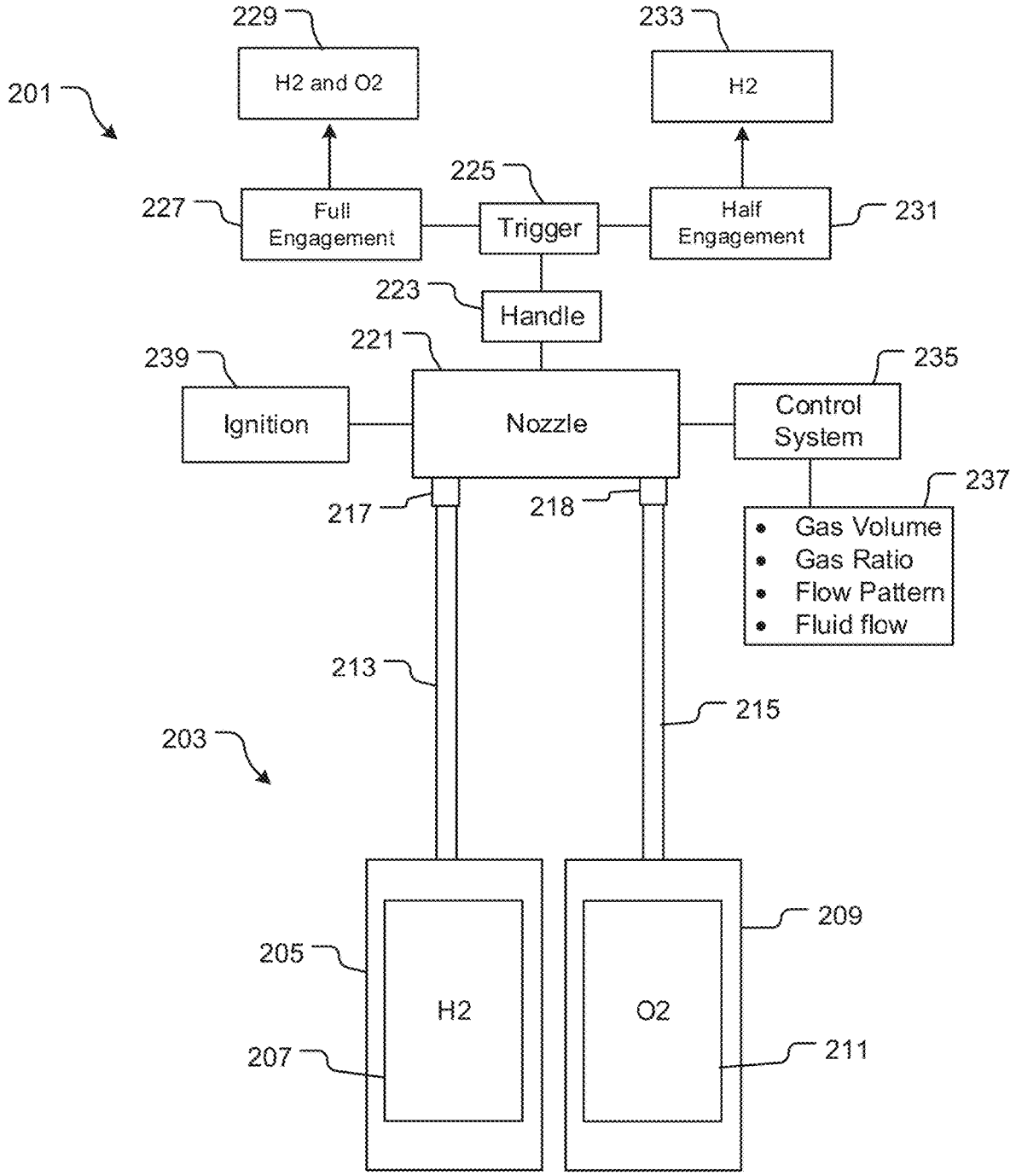
FIG. 2 is a schematic of an oxyhydrogen torch system in accordance with a preferred embodiment of the present application.

Referring now to the drawings wherein like reference characters identify corresponding or similar elements throughout the several views, FIG. 2 depicts a schematic of an oxyhydrogen torch system 201 in accordance with a preferred embodiment of the present application. It will be appreciated that system 201 overcomes one or more of the above-listed problems commonly associated with conventional torch systems.

In the contemplated embodiment, system 201 includes a gas storage system 203 having an oxygen gas storage container 209 configured to hold an amount of oxygen gas 211 and a hydrogen gas storage container 205 configured to hold an amount of hydrogen gas 207. The system 201 further including a first gas line 213 in communication with the hydrogen gas storage container, and a second gas line 215 in communication with the oxygen gas storage container 209. It should be appreciated that the gas lines can be connected together, although with separate flow paths, or alternatively, can be completely separate entities.

The first and second gas lines extend to a nozzle 221 which is connected to the gas lines via a first valve 217 and a second valve 218, the valves configured to open and close to allow gas to flow therethrough.

As shown, nozzle 221 will include a handle 223 which will provide the user with a means to conveniently hold and direct the nozzle, the handle 223 further in communication with a trigger 225 extending therefrom. It should be appreciated that the trigger 225 is in communication with the valves 217, 218 and is thereby configured to open and close the valves to allow gas to flow therethrough. In the preferred embodiment, the trigger operates such that a full engagement 227 will cause the flow of both hydrogen and oxygen gases 229, wherein a half engagement 231 will only cause the flow of hydrogen 233. It should be appreciated that this feature allows for easy user control of the gas flow through the nozzle.

It is contemplated that the nozzle 221 can include additional features, such as an ignition source 239 which provides the heat necessary to create the torch activation. In addition, a control system 235 can be provided that allows for various functional controls 237, including the gas volume control, gas ratio control, gas flow pattern control, and fluid control.

It should be appreciated that one of the unique features believed characteristic of the present application is the configuration of the nozzle in combination with the mixing of hydrogen gas and oxygen gas. The nozzle allows for improved user control associated with the creation of a torch.

Figure 3:
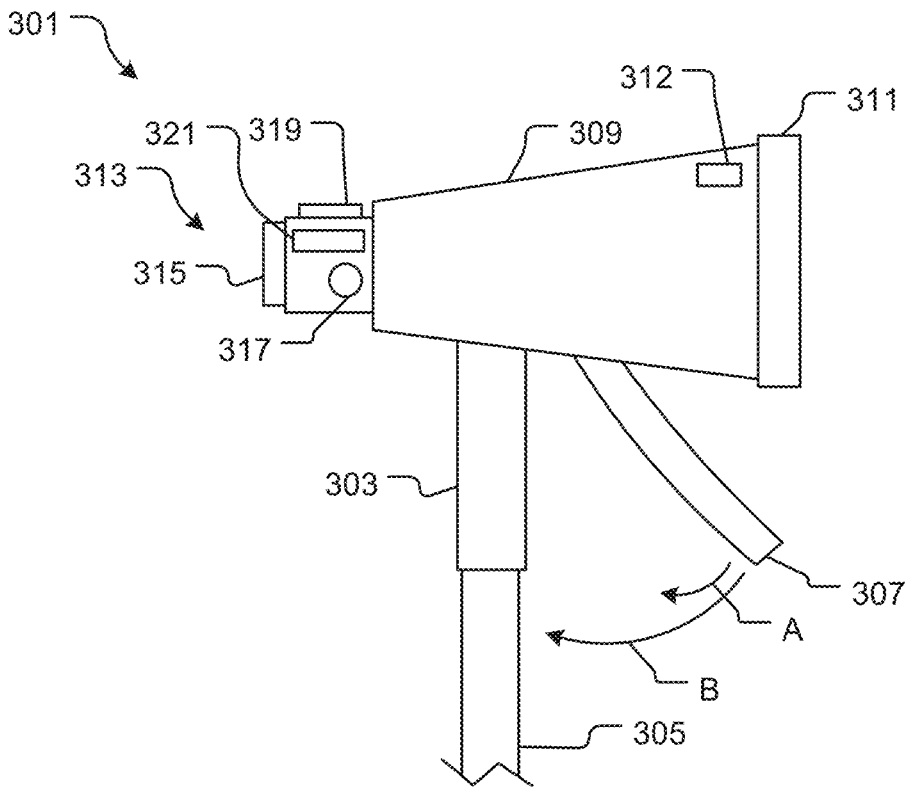
FIG. 3 is a simplified side view of an exemplary embodiment of a nozzle of the system of FIG. 2.

In FIG. 3, a simplified side view of an exemplary embodiment of a nozzle 301 in accordance with the present application. In this embodiment, the nozzle 301 includes a handle 303 that is connected to a gas line 305. The nozzle 301 further including a housing 309 that houses the one or more valves (not shown), that are controlled via a trigger 307. As shown, the trigger 307 can utilize a half engagement (A) or a full engagement (B), wherein the half engagement activates gaseous flow of hydrogen and the full engagement activates gaseous flow of both hydrogen and oxygen. It should be appreciated that the gas will flow through the housing and further through the face 311 of the nozzle, wherein an ignition source 312 provides heat as necessary to create the torch functionality.

Additional features contemplated to incorporate as part of the nozzle 301 include a control system 313, which may include various knobs, levers, wheels, or the like to control various additional elements. For example, the control system 313 can include a fluid flow control 315, a gas ratio control 321, a gas volume control 319, and/or a gas flow pattern control 317.

Figure 4:
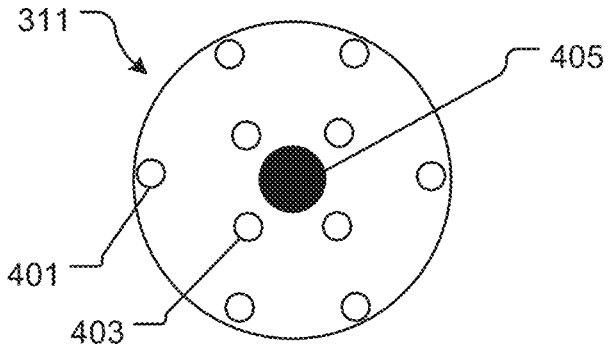
FIG. 4 is a face view of the nozzle of FIG. 3.

In FIG. 4, a front view depicts one exemplary embodiment of a face 311, wherein the face 311 can include a first set of holes 401 for gaseous flow of one of the hydrogen or oxygen gas, and a second set of holes 403 for flow of the other gas. As shown, in this particular embodiment, the holes are arranged in an interior configuration and an exterior configuration. Further shown is a fluid flow hole 405 which may be closed or opened as needed.

Figure 5:
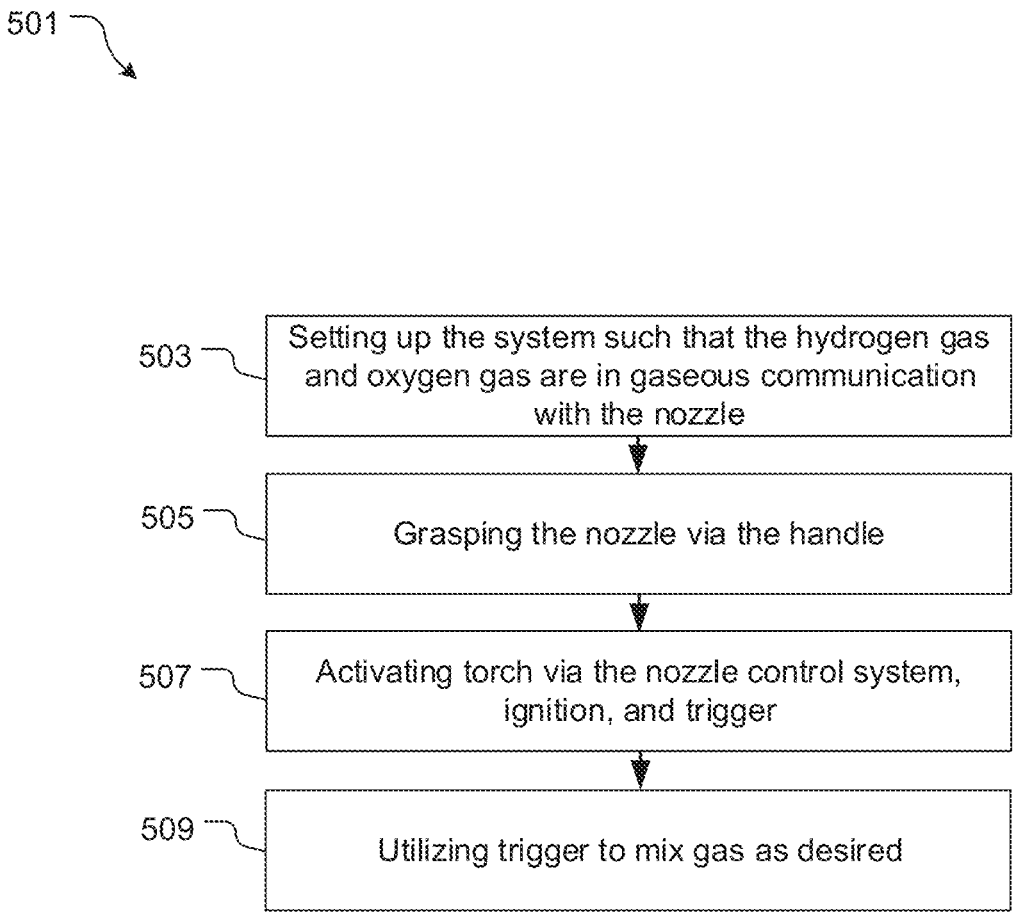
FIG. 5 is flowchart of a method of use of the system of FIG. 2.

In FIG. 5, a flowchart 501 depicts a method of use of system 201. During use, the user will set up the system, as shown with box 503. The user will then grasp the nozzle via the handle such that the user can control the direction and operation of the system, as shown with box 505. The user will then activate the torch via the nozzle control system, ignition, and trigger, as shown with box 507. The system can then be used as desired, as shown with box 509.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An oxyhydrogen torch system, comprising:

a gas storage system, the gas storage system having an oxygen gas storage container and a hydrogen gas storage container;

a first gas line in gaseous communication with the oxygen gas storage container;

a second gas line in gaseous communication with the hydrogen gas storage container;

a nozzle, the nozzle connected to the first gas line and the second gas line via a first valve and a second valve, the first and second valves configured to control gaseous flow through the nozzle, the nozzle further having:

a handle;

a trigger extending from the handle and engaged with the first valve and the second valve, the trigger operates gaseous flow through the nozzle via a half trigger engagement and a full trigger engagement, the half trigger engagement allowing solely hydrogen gas to flow through the nozzle and the full trigger engagement allowing hydrogen gas and oxygen gas to both flow through the nozzle, the half trigger engagement prevents hydrogen flowing through the nozzle; and an ignition source configured to provide heat to gaseous flow through the nozzle;

wherein the nozzle operates a torch created by the hydrogen gas and the oxygen gas; and wherein a gas volume, a gas ratio, and a gas flow pattern are regulated by the nozzle.

2. The system of claim 1, wherein the nozzle further comprising:

a face attached to a body, the body housing the first valve and the second valve, the face having a first set of holes to allow hydrogen gas to flow therethrough and a second set of holes to allow oxygen gas to flow therethrough.

3. The system of claim 1, wherein the nozzle further comprises:

a control system, the control system having:

a gas volume control;

a gas ratio control; and a flow pattern control.

4. A method using a torch, the method comprising;

providing the system of claim 1;

using the nozzle to activate gaseous flow through the nozzle; and pointing the nozzle in a desired direction.

* * * * *